US005447252A

United States Patent [19]

Ward

[11] Patent Number: 5,447,252

[45] Date of Patent: Sep. 5, 1995

[54] HANDLE ASSEMBLY FOR STACKABLE CONTAINERS

[75] Inventor: Barry G. Ward, Decatur, Ala.

[73] Assignee: EFP Corporation, Decatur, Ala.

[21] Appl. No.: 127,064

[22] Filed: Sep. 27, 1993

[51] Int. Cl.[6] ..... B65D 7/24

[52] U.S. Cl. ..... 220/756; 220/770; 220/775

[58] Field of Search ..... 220/770, 773, 774, 776, 220/756, 775

[56] References Cited

U.S. PATENT DOCUMENTS

| | | | |
|---|---|---|---|
| 344,667 | 6/1886 | McDonnell | 220/773 |
| 694,807 | 3/1902 | Vanderburg | 220/774 |
| 893,200 | 7/1908 | Scully | 220/774 |
| 1,939,867 | 12/1933 | Thompson | 220/774 |
| 2,023,399 | 12/1935 | Bullard | 220/774 |
| 2,983,402 | 5/1961 | Gottsegen | 220/773 |
| 3,185,342 | 5/1965 | Gottsegen et al. | 220/776 |
| 4,624,382 | 11/1986 | Tontarelli | 220/770 |
| 4,813,568 | 3/1989 | Fuehrer | 220/775 |
| 5,199,571 | 4/1993 | Wolff et al. | 220/773 |

*Primary Examiner*—Joseph Man-Fu Moy
*Attorney, Agent, or Firm*—John C. Garvin, Jr.

[57] ABSTRACT

A handle assembly for use with expandable polystyrene coolers having a base, a lower section including two pairs of tapered, opposed, walls which extend upwardly and outwardly from the base and terminating in a shoulder, an upper section including two pairs of tapered, opposed, walls which extend upwardly and outwardly from the shoulder, a large and small opening in each wall of one pair of the tapered, opposed, walls of the upper section of the cooler, and a notch within the shoulder and extending into the walls of the one pair of tapered, opposed, walls of the upper section.

The handle assembly of the present invention includes a U-shaped handle member, a pair of handle support assemblies, each including a round male projection, and a pair of female retainer member for mounting within a respective large opening in the tapered, opposed, walls of the upper section for receiving a respective male projection extending from a respective handle support assembly.

14 Claims, 1 Drawing Sheet

HANDLE ASSEMBLY FOR STACKABLE CONTAINERS

TECHNICAL FIELD

This invention relates to stackable containers, and more particularly to stackable, nestable, coolers made from expandable polystyrene (EPS) and having an improved handle assembly that does not impede the stacking of the coolers.

BACKGROUND OF THE INVENTION

The prior art abounds with handles for attachment to containers such as generally rectangular or square EPS coolers. The most conventional of these prior art handles are generally U-shaped and include a gripping section, a pair of arms fixed to the ends of the gripping section, and means for pivotally securing the arms to opposed walls of the container. This pivot arrangement found in the conventional handles, while useful when dealing with a single container, creates problems during the shipping and storage of a relatively large number of such containers. Both the containers and the conventional handles hinder the stacking or nesting, one within another, of the containers during shipping and storage and often results in damage to both the containers and handles.

The drawbacks and disadvantages of the most conventional of prior art handles for coolers include damage caused to the cooler surface due to the fact that it hangs down past a ninety degree angle and that such handles require a slightly larger box for shipping and take up more cubes in a trailer during shipment.

In accordance with the present invention, a novel and improved handle is provided which is reliable, relatively simple in construction, saves time and money in assembly, reduces the possibility of damage to the container and handle during shipping and storage, and overcomes the drawbacks and disadvantages of known handles for such containers.

SUMMARY OF INVENTION

The present invention is directed to a handle assembly for use with coolers having a base, a lower section including two pairs of tapered, opposed, walls which extend upwardly and outwardly from the base and terminating in a shoulder, an upper section including two pairs of tapered, opposed, walls which extend upwardly and outwardly from the shoulder, a large and small opening in each wall of one pair of the tapered, opposed, walls of the upper section of the cooler, and a notch within the shoulder and extending into the walls of the one pair of tapered, opposed, walls of the upper section. The handle assembly of the present invention includes a U-shaped handle member, a pair of handle support assemblies, each including a round male projection, and a pair of female retainer member for mounting within a respective large opening in the tapered, opposed, walls of the upper section for receiving a respective male projection extending from a respective handle support assembly.

During shipping and storage the handle assembly of the present invention permits the stacking of a plurality of the coolers one within the other with each of the handle support assemblies being generally vertical with its upper end nesting within a respective notch extending into the walls of the one pair of tapered, opposed, walls of the upper section of the next higher, stacked cooler, and the U-shaped handle member extending approximately ninety degrees (90°) from the vertically extending handle support assembly and resting on the upper edge of the cooler.

DETAILED DESCRIPTION OF THE INVENTION

Figure 1:
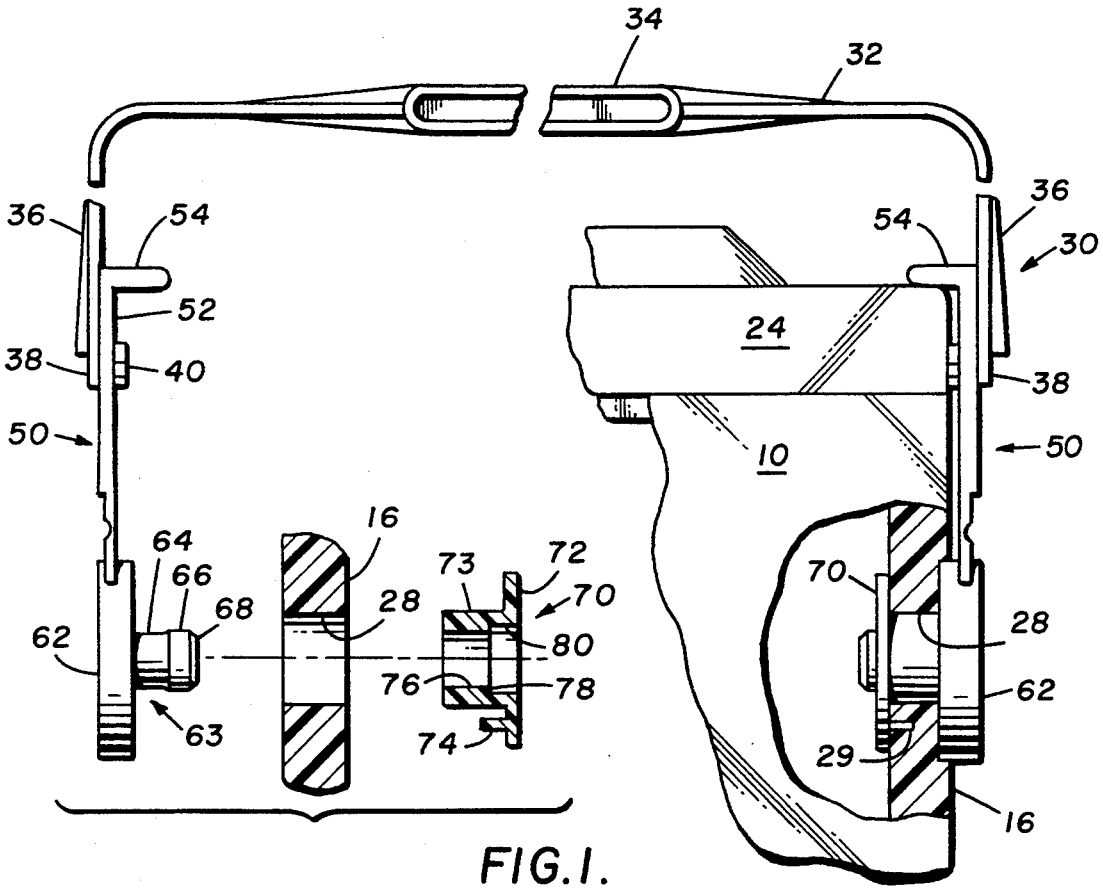
FIG. 1 is an exploded, partially broken away, and partially cross-sectional, view of the handle assembly of the present invention.
Figure 2:
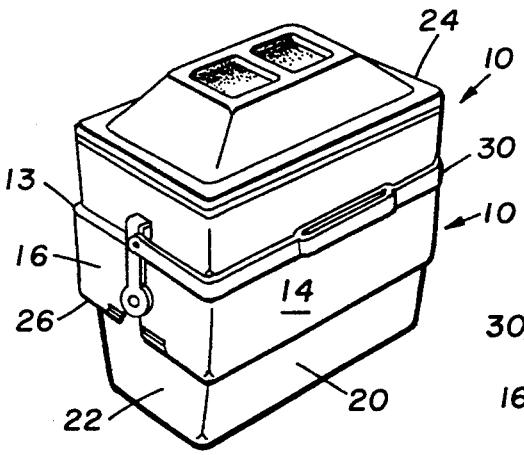
FIG. 2 is a perspective view showing stackable containers and the handle assembly of the present invention.
Figure 4:
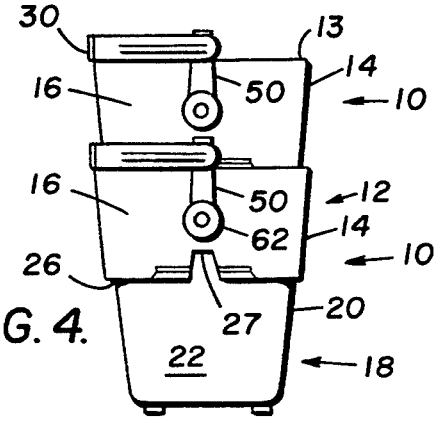
FIG. 4 is an end view showing two stackable containers and the handle assemblies of the present invention.

Referring now to FIGS. 2 and 4, reference numeral 10 generally designates a cooler including an upper section 12 and a lower section 18. Upper section 12 includes an upper edge 13, a first pair of tapered side walls 14 and a second pair of tapered side walls 16 with each tapered side wall 16 including a large round opening 28 (FIG. 1) and a small round opening 29 (FIG. 1). A shoulder 26 (FIG. 4) separates the upper section 12 and lower section 18. The tapered walls 20 and 22 of lower section 18 extend upwardly and outwardly from the base (unnumbered) of cooler 10 and the tapered walls 14 and 16 of upper section 12 extend upwardly and outwardly from shoulder 26 which separates upper and lower sections 12 and 18.

As best shown in FIG. 1, reference numeral 30 generally designates a handle assembly. Handle assembly 30 includes a generally U-shaped handle member 32, an enlarged gripping section 34, and a pair of depending arms 36. Each arm 36 has a male protrusion or projection 40 (FIGS. 1 and 3A) secured to its free end 38 which includes a generally round bearing member 42 having a plurality of substantially radially extending fingers 44 at its free end for purposes to be later explained. As best shown in FIG. 1, reference numeral 50 designates a pair of handle support assemblies. Each handle support assembly 50 includes an upper end portion 52 having a latch member 54 extending therefrom and a generally cylindrical opening 56 (FIG. 3B) therein, three through slots 58 extending substantially radially from cylindrical opening 56 and being complementary with fingers 44 of male projection 40, and a recess or groove 60 extending radially from cylindrical opening 56. Each handle support member 50 further includes a generally circular cooler engaging member 62 having a round male projection 63 secured thereto and extending therefrom. Each male projection 63 includes a reduced round section 64, an enlarged round section 66, and a tapered end 68. As best shown in FIG. 1, a female retainer member 70 is provided for cooperating with each male projection 63 for securing the handle support members 50 to cooler 10. Each female retainer member 70 includes a flange 72, an annular portion 73 and a pin 74 extending from flange 72, a small tapered inner bore 76, a shoulder 78, and a large inner bore 80.

Figures 3A, 3B:
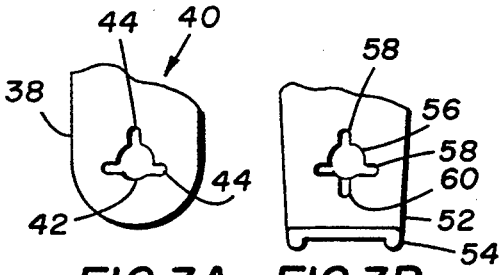
FIGS. 3A and 3B are exploded, partially broken away, views showing the method of connection between one arm and one handle support assembly of the handle assembly of the present invention.

The handle assembly 30 is assembled as follows prior to being secured to the side walls 16 of upper section 12 of cooler 10. Each handle support assembly 50 is turned approximately 180° away from its position as shown in FIG. 1, to the position as shown in FIG. 3A, such that each slot 58 in upper end portion 52 of handle support assembly 50 is in alignment with a respective finger 44 extending from male projection 40 of arms 36 at which time the upper end portion 52 of handle support assembly is moved toward the arms 36 with each finger 44 entering a respective slot 58 until the walls of the generally round opening 56 of handle support assembly 50 are supported on the generally round bearing member 42 of male projection 40, at which time the handle support assembly is rotated approximately 180° to the positions as shown in FIG. 1. In these positions, the arms 36 of U-shaped handle member 32 cannot be separated from its respective handle support assembly 50 and are in a generally vertical position and held or locked in place by the engagement of the most radially extending finger 44 of arms 36 with the walls of grooves or recesses 60 of handle support assembly 50. The function of latch members 54 is to hold the cover or lid 24 on a container 10 as best shown in FIG. 1 and to fit within notches 27 of an adjacent container when the containers are stacked without the lids thereon as best shown in FIGS. 2 and 4.

After the handle assembly 30 is assembled as described hereinabove, it is secured to the side walls 16 of upper section 12 of cooler 10 as follows. The annular portion 73 of each retainer member 70 is inserted into a respective large opening 28 in side walls 16 of cooler 10 from the inside of cooler 10 with the pin 74 extending from flange 72 being in alignment with small round opening 29 in side wall 16 until flange 72 is in engagement with the inner wall (unnumbered) of cooler 10. The male projection 63 extending from generally circular cooler engaging member 62, with handle support member 50 being in a generally vertical position, is inserted into small annular bore 76 of retainer member 70 during which the enlarged round section 66 of male projection 63 and the walls of annular bore 76 of retainer member 70 are deformed until the enlarged section 66 of male projection 63 passes beyond the shoulder 78 of retainer member 70 at which time the enlarged section 66 of male projection 63 and the annular bore 76 return to their normal condition such that the shoulder 78 prevents separation of male projection 63 from retainer member 70.

As best seen in FIG. 4, a plurality of coolers 10 can be stacked with the handle assembly 30 of each cooler 10 extending horizontally and resting on upper edge 13 of cooler 10. In this position, handle assembly 30 is locked in place by the engagement of a finger 44 of each arm 36 with the walls of a respective recess or groove 60 of handle support assembly 50.

While the above description constitutes the preferred embodiment of the present invention, it will be appreciated that the invention is susceptible to modification, variation and change without departing from the proper scope and fair meaning of the accompanying claims.

I claim:

1. A handle assembly configured for use with a container including upper and lower sections, the upper section having an upper edge, each section including first and second pairs of tapered, opposed, walls and being separated by a shoulder, with each first pair of tapered opposed walls of the upper section having at least one pair of openings therein, the handle assembly comprising:

a pair of handle support elements, each including an upper end, a latch member extending from said upper end, a lower end, and a male projection extending inwardly from said lower end;

a U-shaped handle including a gripping section and a pair of arms;

means for pivotally securing said upper end of each of said handle support elements to said arms of said U-shaped handle; and means for mounting within said at least one pair of openings in said upper section of said container for retaining said handle support elements to said first pair of tapered, opposed, walls of said upper section of said container.

2. The handle assembly of claim 1 wherein said means for pivotally securing said upper end of each of said handle support elements to said arms of said U-shaped handle includes a protrusion extending from each of said arms of said U-shaped handle and an opening in said upper end of each of said handle support elements.

3. The handle assembly of claim 2 wherein said means for pivotally securing said upper end of each of said handle support elements to said arms further includes a plurality of fingers extending from each of said protrusions for preventing the separation of said protrusions from the walls of said openings in said upper end of said handle support elements.

4. The handle assembly of claim 3 wherein said means for retaining each of said handle support elements to said first pair of tapered, opposed, walls of said upper section of said container includes a retainer member for receiving said projection extending from said handle support element, said retainer member including a flange, an annular portion extending from said flange, an internal bore having a reduced portion, an enlarged portion, and a shoulder separating said reduced and enlarged portions.

5. The handle assembly of claim 4 wherein said male projection extending from said lower end of said handle support element is generally cylindrical and includes a reduced section, an enlarged section and a tapered section whereby said shoulder of said internal bore of said retainer member engages one edge of said enlarged section of said male projection to secure said retainer member and a respective said handle support element to said tapered, opposed, walls of said upper section of said container.

6. The handle assembly of claim 5 further including means for holding said handle in substantially vertical and horizontal positions with respect to said container.

7. The handle assembly of claim 6 wherein said means for holding said handle in substantially vertical and horizontal positions includes a recess in each of said handle support elements whose walls engage one of said fingers of said arms of said handle.

8. A handle assembly configured for use with a container including upper and lower sections, the upper section having an upper edge, each section including first and second pairs of tapered, opposed, walls and being separated by a shoulder, with each first pair of tapered opposed walls of the upper section having a notch and at least one pair of openings therein, the handle assembly comprising:

a pair of handle support elements, each including an upper end, a lower end, a projection extending inwardly from said lower end, and a latch member extending upwardly from said upper end, each of said projections including a reduced section, an enlarged section and a tapered section;

a U-shaped handle including a gripping section and a pair of arms;

means for pivotally securing said upper end of each of said handle support elements to said arms of said U-shaped handle; and means for mounting within said at least one pair of openings in said upper section of said container for engaging said reduced and enlarged sections of said projections of said handle support element and for retaining said handle support elements to each said first pair of tapered, opposed, walls of said upper section of said container.

9. The handle assembly of claim 8 wherein said means for pivotally securing said upper end of each of said handle support elements to said arms of said U-shaped handle includes a protrusion extending from each of said arms of said U-shaped handle and an opening in said upper end of each of said handle support elements.

10. The handle assembly of claim 9 wherein said means for pivotally securing said upper end of each of said handle support elements to said arms further includes a plurality of fingers extending from each of said protrusions for preventing the separation of said protrusions from the walls of said openings in said upper end of said handle support elements.

11. The handle assembly of claim 10 wherein said means for retaining each of said handle support elements to said first pair of tapered, opposed, walls of said upper section of said container includes a retainer member for receiving said projection extending from said lower end of each said handle support element, said retainer member including a flange, an annular portion extending from said flange, an internal bore having a reduced portion, an enlarged portion, and a shoulder separating said reduced and enlarged portions.

12. The handle assembly of claim 11 further including means for holding said handle in substantially vertical and horizontal positions with respect to said container.

13. The handle assembly of claim 12 wherein said means for holding said handle in substantially vertical and horizontal positions includes a recess in each of said handle support members whose walls engage one of said fingers of said protrusion of said arms of said handle.

14. The handle assembly of claim 13 wherein said latch member extending inwardly from said upper end of said handle support element fits within said notch of a second container stacked upon said container.

* * * * *